United States Patent [19]

Stenner

[11] Patent Number: 4,631,008

[45] Date of Patent: Dec. 23, 1986

[54] PERISTALTIC PUMP HOUSING

[75] Inventor: Gustav H. Stenner, Jacksonville, Fla.

[73] Assignee: G. H. Stenner & Co., Inc., Jacksonville, Fla.

[21] Appl. No.: 794,560

[22] Filed: Nov. 4, 1985

[51] Int. Cl.[4] ..... F04B 43/12; B65D 41/18

[52] U.S. Cl. ..... 417/477; 220/306; 418/70

[58] Field of Search ..... 417/477; 220/306, 307; 418/70

[56] References Cited

U.S. PATENT DOCUMENTS

| | | | |
|---|---|---|---|
| 3,149,747 | 9/1964 | Burgess | 220/306 |
| 3,756,752 | 9/1973 | Stenner | 417/477 |
| 4,079,857 | 3/1978 | Crisci | 220/306 |
| 4,380,304 | 4/1983 | Anderson | 220/307 X |
| 4,496,295 | 1/1985 | King | 417/477 |
| 4,540,350 | 9/1985 | Streicher | 417/477 X |

FOREIGN PATENT DOCUMENTS

| | | | |
|---|---|---|---|
| 1298296 | 7/1969 | Fed. Rep. of Germany | 220/306 |

*Primary Examiner*—John J. Vrablik

*Attorney, Agent, or Firm*—Arthur G. Yeager

[57] ABSTRACT

A housing for a peristaltic pump including a housing body, a roller assembly, a flexible feeder tube, and a cover, the improvement comprising a cylindrical tongue on the housing and a mating groove on the cover adapted to provide a snap-fit releaseable closure.

6 Claims, 11 Drawing Figures

PERISTALTIC PUMP HOUSING

BACKGROUND OF THE INVENTION

Peristaltic pumps are known in the art as devices for precision pumping of various liquids, mixtures of liquids and solids, etc. The pump involves a flexible tube through which the pumped liquid passes. Rollers press the flexible tube against an outer wall capturing a precise volume of liquid between adjacent rollers which volume is discharged from the pump outlet. The servicing and repair of pumps in general usually involves hiring a mechanic who requires special tools and know-how to repair the pump. In the case of peristaltic pumps which are frequently used in connection with residential swimming pools, it has been considered to be highly desirable if the pump could be repaired easily by the home owner who had little or no mechanical capabilities.

It is an object of this invention to provide a pump housing wherein the cover and the housing are releaseably connected by a snap-fit closure means. Still other objects will be apparent from the more detailed description which follows.

BRIEF DESCRIPTION OF THE INVENTION

This invention relates to a peristaltic pump having a housing, a roller assembly, a flexible feeder tube, and a housing cover wherein the improvement comprises a tapered tongue member around the outer perimeter of said housing adapted to frictionally engage a recess around the outer perimeter of said housing cover to close tightly said cover onto said housing without need for additional fastening means.

In specific embodiments the tongue member is a cylindrical projection concentric with the housing and projecting outwardly therefrom, the inside surface of the tongue being generally cylindrical and parallel to the axis of the housing while the outside surface is frustoconical with the larger diameter at the free end of the tongue. This combination produces a tightly fitting snap-on connection between the housing and the cover.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
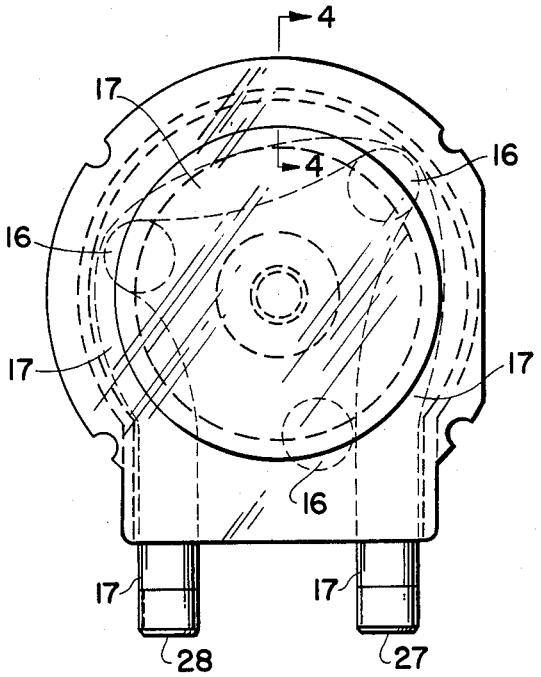
FIG. 1 is a top plan view of a peristaltic pump having the features of this invention.
Figure 2:
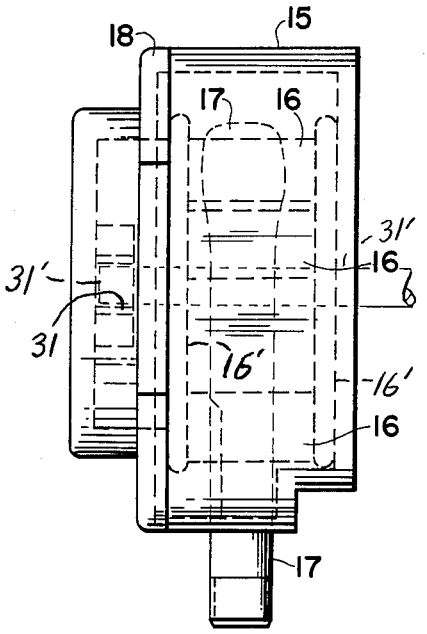
FIG. 2 is a side elevational view of the pump of FIG. 1.
Figure 3:
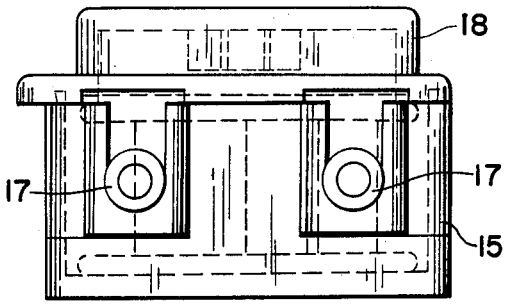
FIG. 3 is a front elevational view of the pump of FIG. 1.
Figure 4:
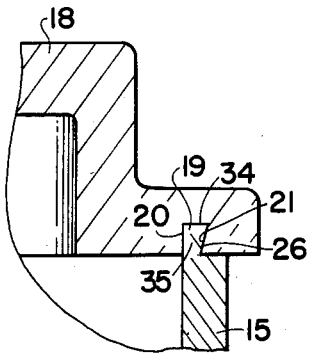
FIG. 4 is a cross-sectional view of the snap-fit connection taken at 4—4 of FIG. 1.
Figure 5:
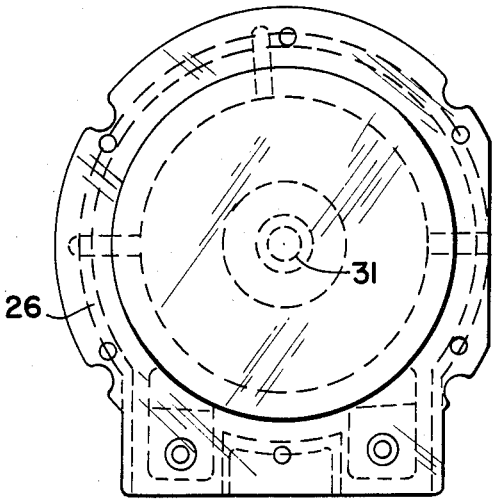
FIG. 5 is a top plan view of the cover of the pump housing.
Figure 6:
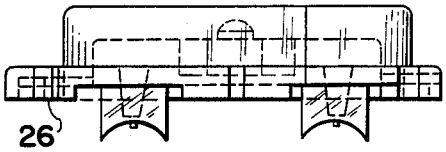
FIG. 6 is a front elevational view of the cover of FIG. 5.
Figure 7:
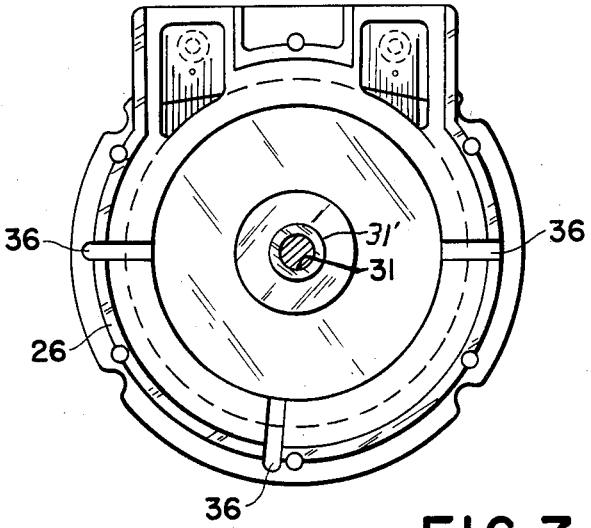
FIG. 7 is a bottom plan view of the cover of FIG. 5.
Figure 8:
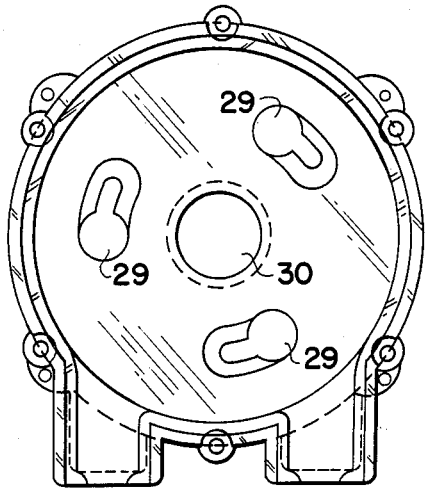
FIG. 8 is a top plan view of the housing body of pump housing.
Figure 9:
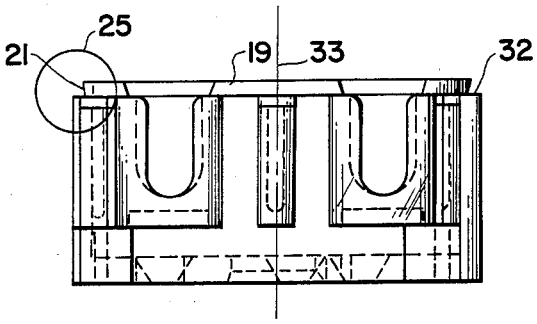
FIG. 9 is a front elevational view of the housing body of FIG. 8.
Figure 10:
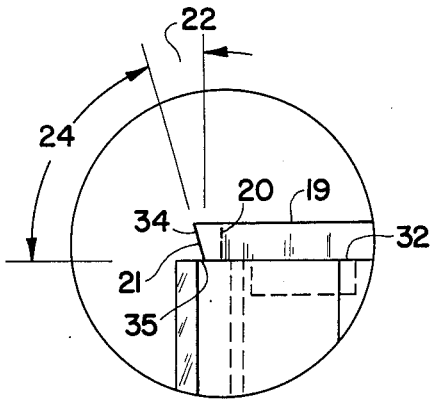
FIG. 10 is an enlarged view of area 25 of FIG. 9.
Figure 11:
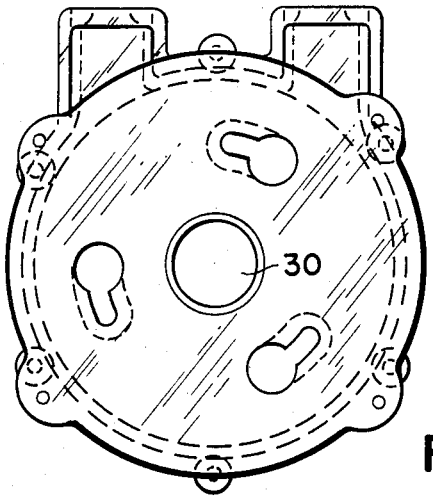
FIG. 11 is a bottom plan view of the housing body of FIG. 8.

In the attached drawings there are shown the features of this invention. The peristaltic pump includes a housing 15 and a cover 18 enclosing a flexible feeder tube 17 and a roller assembly 16. In such a pump the roller assembly 16 has three or more rollers between a pair of spaced plates 16′ which are rotated while pressing tube 17 against the inside wall of housing 15. This produces a volume of liquid inside tube 17 between adjacent rollers of assembly 16 which is forced out of tube 17 as the assembly rotates. If roller assembly 16 as seen in FIG. 1 rotates counterclockwise, the suction side of the pump is inlet end 27 of tube 17 and the pressure side of the pump is outlet end 28 of tube 17. Housing 15 and cover 18 provide an enclosure for roller assembly 16 and anchor points for tube 17 near its two ends. Housing 15 is attachable to the housing of a driving means, which normally includes an intermittent drive and electrical motor (all not shown) by means of slots 29 which cooperate with screw heads on the housing of the driving means. The motor shaft 31′ passes through hole 30 in the bottom of housing 15, is affixed to plates 16′ of roller assembly 16 by means of a flattened portion of the shaft 31′, and is supported in bearing 31 in cover 18. Peristaltic pumps are known in the prior art as evidenced by my patent, U.S. Pat. No. 3,756,752 which shows such driving means and prior art pump.

In accordance with this invention, cover 18 is removably attachable to housing body 15 by a snap-fit attachment which does not require any additional fastening devices. This is achieved by the cooperation of a tongue 19 on housing 15 with groove 26 on cover 18. Tongue 19 projects upwardly in a generally cylindrical configuration from the upper surface 32 of housing 15. Tongue 19 has an inner surface 20 which is generally cylindrical about longitudinal axis 33 of housing 15. Outer surface 21 is frustoconical with outer end 34 of tongue 19 being larger in diameter than inner end 35. Angle 22 between surface 21 and axis 33 is about 5°–15°, preferably about 10°. Correspondingly, angle 24 between surface 21 and surface 32 is about 75°–85°, preferably about 80°.

Groove 26 in cover 18 is substantially similar in shape to tongue 19 so as to fit tightly over tongue 19 with a snap-fit. The inside wall of groove 26 is cylindrical and the outside wall has a frustoconical surface identical to surface 21 of tongue 19. Because of the tight fit between tongue 19 and groove 26 there are one or more relief grooves 36 intersecting groove 26 to permit the free flow of air into and out of groove 26 when cover 18 is removed from or attached to housing 15. Grooves 36 also serve to permit water to flow through in the event water should get inside housing 15. It will be seen that outer end 34 of tongue 19 must be slightly deformed or compressed in order for groove 26 to receive tongue 19 in a mating engagement. This deforming compression results in a snap-fit holding cover 18 tightly against housing 15.

Housing 15 and cover 18 are preferably made of tough plastic such as polysulfone, polycarbonate, polyacetal, polyamide, polyvinylchloride, or the like, so as to provide the necessary resilience and corrosion resistance. Preferably, these plastics are reinforced with fibers of glass or other inert materials to provide greater strength properties, and are substantially transparent.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. In a peristaltic pump having a housing, a roller assembly, a flexible feeder tube, and a housing cover, the improvement which comprises a tapered tongue member around the outer perimeter of said housing adapted to frictionally engage a recess around the outer perimeter of said housing cover to close tightly said cover onto said housing without need for additional fastening means, said housing being generally cylindrical about a central longitudinal axis, said tongue member includes an inward cylindrical surface generally parallel to said axis and an outward frustoconical surface wherein the angle of taper is about 5°–15° from said axis, the outer extremity of said frustoconical surface being larger in diameter than the inner end of said tongue.

2. In the pump of claim 1 wherein said angle of taper is about 10°.

3. In the pump of claim 1 wherein said housing cover has a circular groove to mate with said tongue, the cross-sectional sizes and shapes of said tongue and said circular groove being substantially identical.

4. A peristaltic pump comprising a stationary U-shaped flexible tube, a shaft, a rotatable spider affixed to said shaft and having mounted thereon three equally spaced rollers bearing outwardly against the inside circumference of said tube, a generally cylindrical stationary cup-shaped housing encircling the outside circumference of said tube and having an open side, and a cover adapted to releaseably close said open side; said housing having a cylindrical tongue concentric with said housing and extending outwardly from one end thereof and having an inner cylindrical surface and an outer frustoconical surface tapering outwardly from a smaller diameter at its juncture with said housing to a larger diameter at its free end, the angle of said frustoconical surface being about 10° with respect to said inner surface, said cover having a circular groove in its surface mating with said housing, said groove having an inner surface substantially cylindrical in shape and an outer frustoconical surface at an angle of about 10° with said cylindrical surface, said groove having a larger diameter with respect to its frustoconical surface at the top of said groove than at said surface mating with said housing and a plurality of radial grooves intersecting said circular groove and adapted to permit passage of air and water from inside to outside and outside to inside said housing, said circular groove adapted to snap-fit onto said tongue without the necessity of additional fastening devices.

5. In the pump of claim 4 wherein said cover additionally includes a recess to function as a bearing for said shaft to which said rotor assembly is affixed.

6. In the pump of claim 4 wherein said housing and said cover are made of tough, transparent glass fiber reinforced plastic materials.

* * * * *